US008348553B2

(12) United States Patent
Simpson et al.

(10) Patent No.: US 8,348,553 B2
(45) Date of Patent: Jan. 8, 2013

(54) BRIDGE PIER AND ABUTMENT SCOUR PREVENTING APPARATUS WITH VORTEX GENERATORS

(75) Inventors: Roger L. Simpson, Blacksburg, VA (US); K. Todd Lowe, Blacksburg, VA (US); Quinn Q. Tian, Blacksburg, VA (US)

(73) Assignee: Applied University Research, Inc., Blacksburg, VA (US)

( * ) Notice: Subject to any disclaimer, the term of this patent is extended or adjusted under 35 U.S.C. 154(b) by 0 days.

(21) Appl. No.: 13/116,119

(22) Filed: May 26, 2011

(65) Prior Publication Data

US 2012/0134753 A1 May 31, 2012

Related U.S. Application Data

(60) Provisional application No. 61/350,149, filed on Jun. 1, 2010.

(51) Int. Cl.
*E02B 3/04* (2006.01)

(52) U.S. Cl. ..... 405/211; 405/15; 405/74

(58) Field of Classification Search ..... 405/15, 405/16, 18, 73, 74, 211, 21, 25; 114/243, 114/264, 265
See application file for complete search history.

(56) References Cited

U.S. PATENT DOCUMENTS 5,839,853 A * 11/1998 Oppenheimer et al. ..... 405/60
2009/0052989 A1 * 2/2009 Bonilla Gris ..... 405/21

OTHER PUBLICATIONS

Barkdoll et al., "Countermeasures to Protect Bridge Abutments from Scour", NCHRP Report 587, 2007, pp. 1-3, Washington, D.C.
Ettema et al., "A review of scour conditions and scour-estimation difficulties for bridge abutments", KSCE Journal of Civil Engineering, Nov. 2004, pp. 643-65,vol. 8, No. 6.
Hunt, B., "Monitoring Scour Critical Bridges", NCHRP Synthesis 396, 2009, pp. 1-2, Washington, D.C.
Lagasse et al., "Bridge Scour and Stream instability Countermeasures", FHWA Technical Report Hydraulic Engineering Circular No. 23, Mar. 2001, pp, 3.10-3.14.
Pauley et al., "Experimental Study of the Development of Longitudinal Vortex Pairs Embedded in a Turbulent Boundary Layer", AIAA Journal, 1988, pp. 816-823, vol. 26, No. 7.
Richardson et al., "Evaluating scour at bridges", FHWA Technical Report Hydraulic Engineering Circular No. 18, May 2001, pp. 1.1-1.8.
Sheppard et al., "Scour at Wide Piers and Long Skewed Piers", NCHRP Report 682, 2011, pp. 26, Washington, D.C.
Simpson, "Turbulent Boundary Layer Separation", Annual Review of Fluid Mechanics, 1989, pp. 205-207, 231-234, vol. 21.
Simpson, "Aspects of Turbulent Boundary Layer Separation", Progress in Aerospace Sciences, 1996, pp. 457-521, vol. 32, (abridged version supplied).

(Continued)

*Primary Examiner* — Sean Andrish
(74) *Attorney, Agent, or Firm* — Berenato & White, LLC

(57) ABSTRACT

Disclosed is a manufactured three-dimensional convex-concave fairing with attached vortex generators, for hydraulic structures such as bridge piers and abutments, whose shape prevents the local scour problem around such hydraulic structures. The device is a conventionally made concrete or fiber-reinforced composite, or combination of both, vortex generator equipped hydrodynamic fairing that is fit or cast over an existing or new hydraulic structure around the base of the structure and above the footing. The vortex generators are positioned so as to energize decelerating near wall flow with higher-momentum outer layer flow. The result is a more steady, compact separation and wake and substantially mitigated scour inducing vortical flow.

19 Claims, 18 Drawing Sheets

OTHER PUBLICATIONS

Simpson, "Junction Flows", Annual Review of Fluid Mechanics, 2001, pp. 415-443, vol. 33 (Demonstrates technical competence and information.).

Tian et al., "A laser-based optical approach for measuring scour depth around hydraulic structures", ASCE 5th Int'l Conference on Scour and Erosion, Nov. 7-11, 2010, pp. 1-10.

* cited by examiner

BRIDGE PIER AND ABUTMENT SCOUR PREVENTING APPARATUS WITH VORTEX GENERATORS

This application claims the benefit of U.S. Provisional Ser. No. 61/350,149, filed Jun. 1, 2010.

The patent or application file contains at least one drawing executed in color. Copies of this patent or patent application publication with color drawing(s) will be provided by the Office upon request and payment of the necessary fee.

FIELD OF THE INVENTION

The invention generally relates to the fields of Civil Engineering, Hydraulic Engineering, and Soil and Water Conservation. More specifically, the invention relates to a manufactured device to prevent scour around hydraulic structures.

BACKGROUND OF THE INVENTION

Removal of river bed substrate around bridge pier and abutment footings, also known as scour, presents a significant cost and risk in the maintenance of many bridges throughout the world. Bridge scour at the foundations of bridge piers and abutments is one of the most common causes of highway bridge failures. It has been estimated that 60% of all bridge failures result from scour and other hydraulic-related causes (Jean-Louis Briaud, 2006). In 1973, a study by the US Federal Highway Administration (FHWA) was conducted to investigate 383 bridge failures caused by catastrophic floods, and it concluded that 25 percent involved pier damage and 72 percent involved abutment damage (Richardson et al., 1993). This has motivated research on the causes of scour at bridge piers and abutments (Ettema et al., 2004) and led bridge engineers to develop numerous countermeasures that attempt to reduce the risk of catastrophe. Unfortunately, all such countermeasures currently in existence and practice are temporary responses that cannot endure throughout the lifetime of the bridge and do not prevent the formation of scouring vortices, which is the root cause of the local scour. Consequently, sediment such as sand and rocks from around the foundations of bridge abutments and piers is loosened and carried away by the flow during floods, which may compromise the integrity of the structure. Due to the temporary nature of available scour countermeasures for at-risk bridges, expensive monitoring technologies and support professionals are required to enable sufficient time for implementing contingency plans when failure is likely. Even designing bridge piers or abutments with the expectation of some scour is highly uncertain, since a recently released study (Sheppard et al., 2011) showed huge uncertainties in scour data from hundreds of experiments. None of the conservative current bridge pier and abutment footing or foundation designs prevent scouring vortices, so the probability of scour during high water or floods is present in all current designs.

The bridge foundations in a water current (WC), such as piers (P) and abutments (A), change the local hydraulics drastically because of the appearance of large-scale unsteadiness and shedding of coherent vortices, such as horseshoe vortices (HV). FIG. 1 is a sketch of the horseshoe vortex (HV) formed around the base of a hydraulic structure by a separating boundary layer. The horseshoe vortex (HV) has high lift and shear stress and triggers the onset of sediment scour and a scour hole (SH) is formed as shown in FIG. 1.

The flow field around a vertical-wall abutment (A) is highly three-dimensional and involves strong separated vortex flow around the abutment as shown in FIG. 2. A separation bubble (SB) is formed at the upstream corner of the abutment. Unsteady shed wake vortices (WV) are created due to the separation of the flow at the abutment corners. These wake vortices (WV) are very unsteady, are oriented approximately vertical and have low pressure at the vortex cores. These vortices act like small tornadoes, lifting up sediment from the sediment bed (SB) and creating a large scour hole (SH) behind the abutment (A) and a downstream scour hole (DSH). The down flow (DF) at the front of the abutment is produced by the large vertical stagnation pressure gradient of the approaching flow. The down flow rolls up and forms the primary vortex (PV) as shown in FIG. 2, which is similar to the formation of the horseshoe vortex around a single bridge pier. FIGS. 3 and 4 show the flowfield (FF) past a wing-wall abutment (A) and spill-through abutment (A), respectively, where deep contraction scour can occur due to vortices, high turbulence (HT), and flow separation zones (FS).

Bridge scour is comprised of three components: long-term aggradations and degradation of the river bed, general scour at the bridge, and local scour at the piers or abutments (Lagasse et al., 2001). The structural countermeasures are used primarily to minimize local scour such as extended footings, scour collars, pier shape modifications, debris deflectors, and sacrificial piles, all of which are only marginally effective. A number of collar devices (Inman, U.S. Pat. No. 3,529,427; de Werk, U.S. Pat. No. 4,279,545; Larsen, U.S. Pat. No. 3,830,066; Larsen, U.S. Pat. No. 3,844,123; and Pedersen, U.S. Pat. No. 3,859,803) encircle the lower end of hydraulic structures, but do not prevent scour on the downstream side of the structure. A similar anti-scour apparatus comprising an upper and a lower collar was patented by Loer (U.S. Pat. No. 4,717,286). U.S. Pat. No. 4,114,394 by Larsen describes the use of a sheet or sack housing film material, which is secured around a hydraulic structure with cables. All of the above collar devices would only have a local effect and local scour will still happen around the vicinity of the collar, as shown by Tian et al. (2010) in work performed in the AUR flume in U.S. Pat. No. 5,839,853 (Oppenheimer and Saunders), one structure of vortex generators, located upstream of the hydraulic structure, is specified to produce a pair of stream-wise vortices that move toward the free surface and protect the hydraulic structure from the impact of oncoming debris. Another structure of vortex generators is positioned directly in front of the hydraulic structure to prevent the streambed from scouring by counteracting the horseshoe vortex (HV) (also sometimes called the necklace vortex) formed by separation at the hydraulic structure nose if there was no control. Simpson (2001) showed that this counteracting mechanism fails as a scour countermeasure.

For abutments, Barkdoll et al. (2007) reviewed the selection and design of existing bridge abutment countermeasures for older bridges, such as parallel walls, spur dikes located locally to the abutment, and horizontal collar-type plates attached to the abutment. Two similar collar devices (Lee et al., U.S. patent Ser. No. 10/493,100; Mountain, U.S. patent Ser. No. 11/664,991) are comprised of a number of interlocking blocks or bags in a monolayer or multilayer on the stream bed around abutments. However, these horizontal collar type scour countermeasures are only marginally effective as shown in the flume test results of Tian et al. (2010). The scour hole at the upstream abutment corner is eliminated, but the downstream scour hole due to the wake vortex shedding becomes more severe. In another approach to prevent streambed scour of a moving body of water, a scour platform is constructed by placing an excavation adjacent to the body of water (Barrett & Ruckman, U.S. Pat. No. 6,890,127). The excavation is covered with stabilizing sheet material, filled with aggregate, and extends up or downstream a desired length. However, the local scour around the excavation is inevitable, especially when the excavation is exposed to a moving body of water.

SUMMARY OF THE INVENTION

Discussed is a unique and novel device which has been proven under rigorous and controlled model scale experiments to prevent the formation of vortices that cause scour or the removal of bed substrate around bridge pier and abutment footings during high flow events. The streamlined control Against Underwater Rampage (scAUR™, pronounced like 'scour') device herein is effective at preventing vortices that cause substrate transport for a large range of river flow conditions and bed substrate materials because it fundamentally alters the way the river flows around the pier. Recently published research sponsored by the National Co-operative Highway Research Program (NCHRP) using hundreds of sets of scour data (Sheppard, et al., 2011) shows that model-scale bridge scour experiments produce much more severe scour depth to pier size ratios than the scour depth to pier size ratios observed for full-scale cases due to scale or size effects. Thus, the current invention will work just as well in preventing the scouring vortices and any scour at full scale as at the proven model scale.

The benefits to bridge owners and managers include actual cost reductions by reducing the frequency and complexity of monitoring practices for scAUR™-fitted bridges and elimination of temporary fixes that require costly annual or periodic engineering studies and construction to mitigate scour on at-risk bridges. The probability of bridge failure and its associated liability to the public is totally avoided since the root cause of local scour is prevented.

The present invention in practice is a concrete or fiber-reinforced composite, or combination of both, hydrodynamic fairing that is fit or cast over an existing or new hydraulic structure around the base of the structure and above the footing. The product is manufactured using existing technologies well known to professionals proficient in the practice of fiber-reinforced composite mold manufacturing and bridge construction. As such, the product can be produced at minimal cost and with high probability of endurance over a long future period.

The shape of a particular device according to the present invention is fully three-dimensional (FIGS. 5 and 6) and cannot necessarily be described either through mere replication or similarity of any of the device's cross sectional shapes in the context of the particular fairing shapes and vortex generator positions determined to solve a particular scour problem. Rather, computational fluid dynamics (CFD) and water flume river bed scour studies are used to design, iterate upon and prove a shape for given sets of river flow and bed conditions to prevent the vortical flow conditions that cause scour. A requirement of the design is that the stream-wise gradient of surface vorticity flux must not exceed the vorticity diffusion rate in the boundary layer, thus preventing the formation of a discrete vortex. Another requirement is that a minimal size of the fairing be used that meets the first requirement. Multiple optimal solutions are possible for a given pier or abutment. Examples implementing the principles of the invention are disclosed herein.

In general, a single, fully three-dimensionally shaped optimized fairing with the help of specially designed vortex generators will prevent scour for a range of angles between the on-coming river flow and the pier centerline from −20° to +20°, with 0 angle defined when the flow is aligned with the pier centerline axis or side of an abutment.

One can generalize the use of the vortex generators for various cases and applications. First, the vortex generators, such as the low drag asymmetric vortex generator (VorGAUR™), should be located on the sides of the fairing well upstream of any adverse or positive pressure gradients and only in flow regions where there are zero pressure gradients or favorable or negative pressure gradients that will persist downstream of the vortex generator for at least one vortex generator length. This results in a well-formed vortex without flow reversal that can energize the downstream flow and prevent separation of the downstream part of the fairing. Secondly, the vortex generator should be at a modest angle of attack angle of the order of 10 to 20 degrees. Multiple vortex generators may be used on the sides of the fairing, as shown in FIGS. 5 and 6. The height and maximum width of the vortex generators need not be greater than the thickness of the approaching turbulent boundary layer upstream of the location of the vortex generators. The spacing between the vortex generators up the side of the fairing should be at least twice the maximum width of the vortex generator or twice the length of the vortex generator times the sine of the angle of attack, whichever is larger.

A fluid mechanics engineer of ordinary skill would be able to implement the invention herein using and understanding the nomenclature (pressure gradients, stream-wise gradient of surface vorticity flux, vorticity diffusion rate, boundary layer thickness, angle of attack) and be able to compute the unseparated flow over an upstream part of a body (i.e., a fairing, pier, or abutment) and determine the locations where the flow has a zero or negative pressure gradient, the boundary layer thickness along the flow over the object, and the locations and regions downstream of the vortex generators where the pressure gradient would be negative or positive. These basic computations would enable, in accord with the principles of the invention, the sizing and shaping of the respective fairing and vortex generators and the positioning and implementation of the one or more vortex generators to energize the flow at discrete locations and eliminate the flow leading to riverbed scour.

The innovative scour prevention device in this present invention belongs to the structural countermeasure category. Unlike the conventional structural countermeasures, this scour countermeasure device is invented based on a deep understanding of the scour mechanisms of the flow and consideration of structural and hydraulic aspects (Simpson 2001). A hydraulically optimum pier fairing prevents the formation of highly coherent vortices around the bridge pier or abutment and reduces 3D separation downstream of the bridge pier or abutment with the help of the vortical flow separation control technique developed here.

In addition, these results show that the smooth flow over the pier or abutment produces lower drag force or flow resistance and lower flow blockage because low velocity swirling high blockage vortices are absent. As a result, water moves around a pier or abutment faster above the river bed, producing a lower water level at the bridge and lower over-topping frequencies on bridges during flood conditions for an water level, inflow turbulence level, or inflow swirling flow level. While tested at model scale, there was no place for debris to get caught or no debris build up in front or around a pier or abutment with the scAUR™ and VorGAUR™ products. In cases where river or estuary boat or barge traffic occurs, the scAUR™ fairing can be constructed to withstand impact loads and protect piers and abutments.

Therefore, the optimum streamline pier or abutment fairing shape with attached vortex generators works effectively as a bridge pier and abutment scour countermeasure. This invention will not only prevent local scour, produce lower flow resistance or drag force on the bridge pier or abutment, produce lower flow blockage because low streamwise velocity swirling vortices are absent, and thus produce a lower river level, but also minimize the potential for buildup of ice and debris and protect the pier or abutment from impact loads. The AUR scAUR™ product design concept is intended to address the FHWA's Plan of Action on scour countermeasures (Hydraulic Engineering Circular No. 23, commonly 'HEC-23'), such as avoiding adverse flow patterns, streamlining bridge elements, designing bridge pier foundations to resist scour without relying on the use of riprap or other countermeasures, etc.

DETAILED DESCRIPTION OF EXAMPLES OF THE INVENTION

Since bridge piers and abutments are the most common hydraulic substructures, in the following description we use bridge piers and an abutment as examples for proof of concept; the local vortex preventing scour countermeasure technique described here can be extended to other hydraulic substructures.

Figure 1:
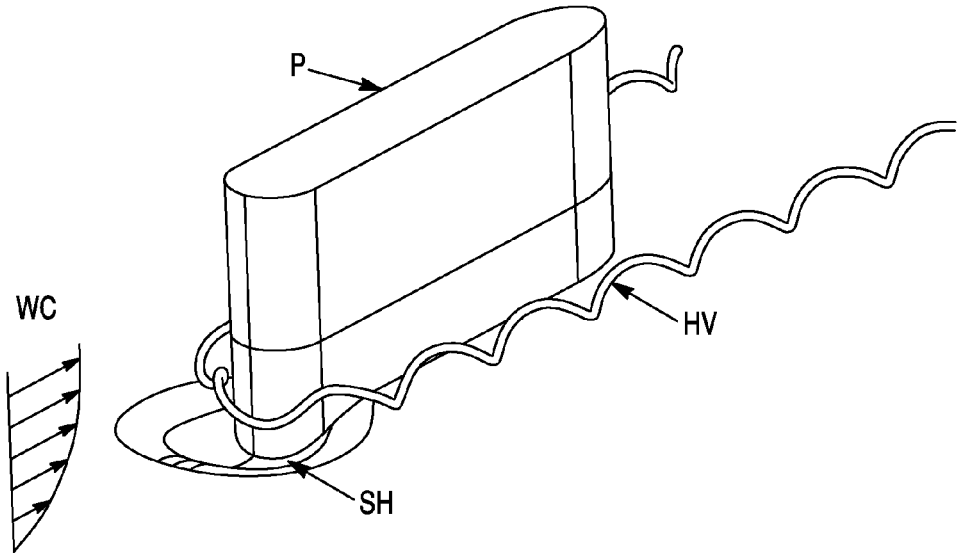
Fig. 1 Prior Art
FIGS. 1 through 4 (labeled "prior art") show bridge piers and abutments with no prevention of scouring vortices.
Figure 5A:
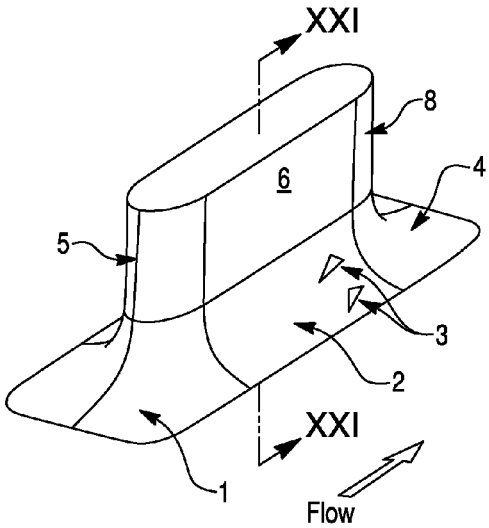
FIGS. 5*a* and 5*b* show the present anti-scour vortex preventing device and its components for 2 different vortex preventing designs for the bottom of bridge piers.
Figure 5B:
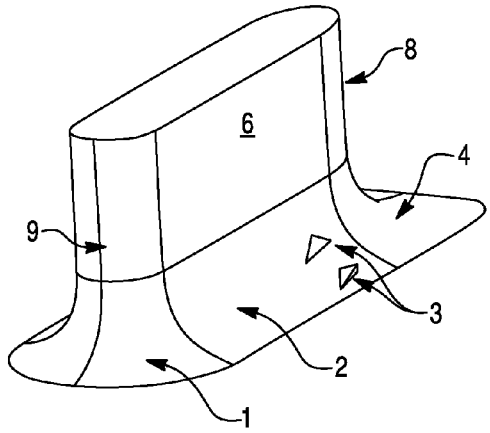
Figure 6:
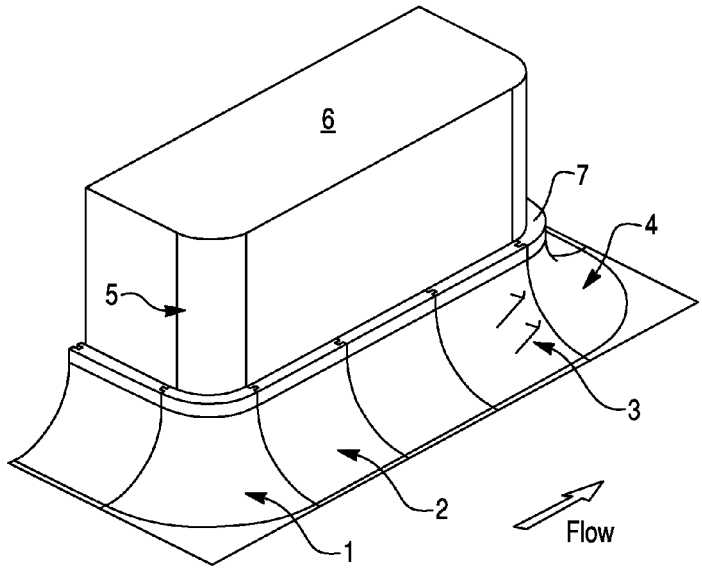
FIG. 6 shows the anti-scour vortex preventing device and its components for a vortex preventing design for the bottom of bridge abutments.
Figure 7A:
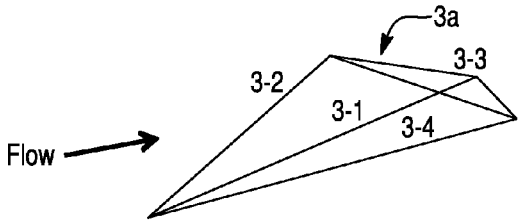
FIGS. 7*a*-7*e* illustrate detailed views of the vortex generator devices used in the invention.
Figure 7B:
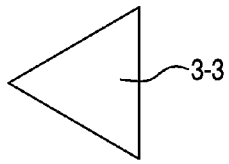
Figure 7C:
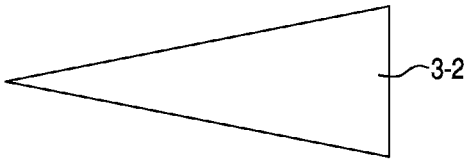
Figure 7D:
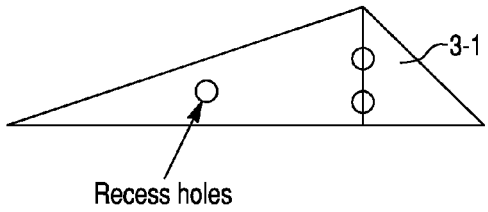
Figure 7E:
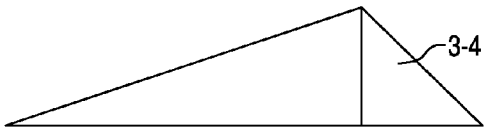

A global view of the invention and its components is shown in FIGS. 5 and 6 for bridge piers and an abutment. FIG. 7 contains a detailed view of the vortex generator devices used in the invention. The components include:

1. Hyper-ellipse convex-concave bridge pier or abutment fairing nose
2. Faired prismatic apron
3. Specially designed vortex generators
4. Hyper-ellipse downstream fairing
5. Faired elliptical pier or abutment nose
6. Existing bridge pier or abutment
7. Interlocking key between sections of the fairing
8. Faired elliptical pier downstream surface or stern
9. Existing or faired circular pier nose
3*a* Vortex generator assembly
3-1 Base plate of vortex generator
3-2 Upstream Side plate
3-3 Downstream side plate
3-4 Vertical side plate The vortical flow that approaches the bridge pier (6) of FIG. 5 encounters the hyper-elliptical or circular (1) fairing nose. These shapes reduce the adverse pressure gradients in the flow and keep the approaching boundary layer attached to the pier surface. By keeping the boundary layer attached, the vortical 'roll-up' into a discrete vortex as illustrated in FIG. 1 is avoided. The flow attached to the noses (1) continues to flow around the body and remains attached over the faired prismatic sections (2). At the downstream end of the pier, the flow will naturally decelerate and produce large-scale unsteady structures with varying lift and shear. Two vortex generators (3) placed on both span-wise sides of the fairing mitigate the separation-induced large scale structures by energizing the decelerating, near wall flow with higher-momentum outer layer flow. The energized flow encounters the faired downstream structure (4) and produces a more steady, compact separation and wake. The faired abutment nose, downstream surface (stern) and pier nose (5,8,9) promote more steady, attached flow on the upper pier structure to avoid strong vortical shedding or vertical vortex attachment that extend down to the river bed. As shown in FIGS. 5*a*, and 5*b*, the fairing includes a streamlined nose 5, 9 and a streamline stern 8. Each of the nose 5, 9 stern 8 have a convex shape along each horizontal plane and a concave shape along each vertical plane perpendicular to the fairing surfaces defined by the nose 5, 9 and stern 8. The convex and concave shapes intersect at each point on the surface of said streamlined nose and stern.

The vortex generator (3) used here is a tetrahedron-a polyhedron composed of four triangular faces, three of which meet at each vertex. This shape is chosen specifically because it acts to deter build-up of debris that will be present in flood conditions. There is no known prior work that utilizes this design. Other different kinds of vortex generators used to control boundary layer separation are described in the following patents (Kuethe 1973 and Wheeler 1991).

Figure 8:
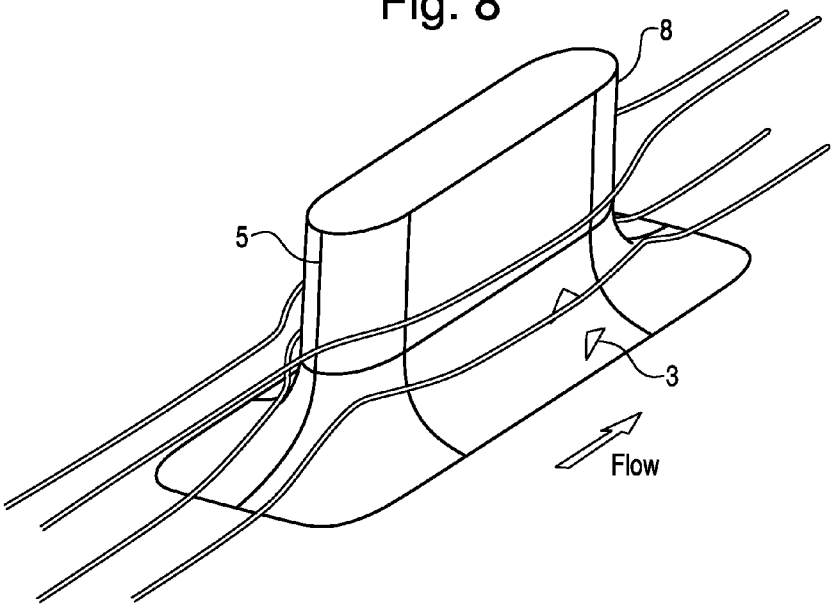
FIG. 8 shows flow around the streamlined bridge pier fairing that remains attached without the formation of vortices.

A number of streamlined bridge pier fairing shapes have been designed and tested. The two optimized designs in FIG. 5 were chosen because they do not produce vortices. As shown in FIG. 5, the shape of these fairing devices is fully three-dimensional and cannot necessarily be described either through mere replication or similarity of any of the cross sectional shapes. The oncoming flow climbs up along the upstream streamlined fairing and stays attached illustrated schematically in FIG. 8. The action just described elevates the vortical regions that may otherwise result in the formation of a horseshoe vortex. Note that there is no separation on the windward portions of the fairing.

Figure 9:
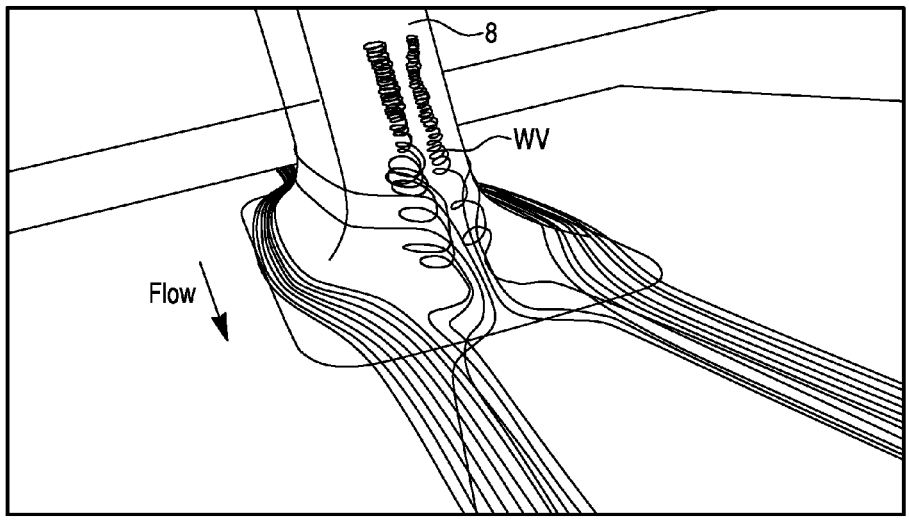
FIG. 9 shows the leeside of the bridge pier fairing under severe adverse pressure gradients with highly inclined separation vortices around the rear of the pier.

As shown in FIG. 9, the leeside of the fairing is under severe adverse pressure gradients. A trailing vortex pair appears downstream of the fairing and pier in an orientation almost parallel to the streambed. Flow separation appears on the downstream fairing when no vortex generators are present. In practical use, vortex generators are introduced to control flow separation on the downstream fairing.

The physics behind using vortex generators to control three-dimensional separation is to bring high momentum flow close to the wall by the flow field of the induced streamwise vortices. Each vortex that is generated acts to energize the near-wall flow, enabling the flow to remain attached further downstream on the pier fairing surface. As shown in FIG. 5, two vortex generators are attached to each side of a bridge pier model which are located at one vortex generator length upstream of where the pressure gradient becomes adverse and at an angle of attack (18 degrees in these figures) to the approaching flow, as chosen due to previous work in the field (Pauley and Eaton, 1988).

Figure 2:
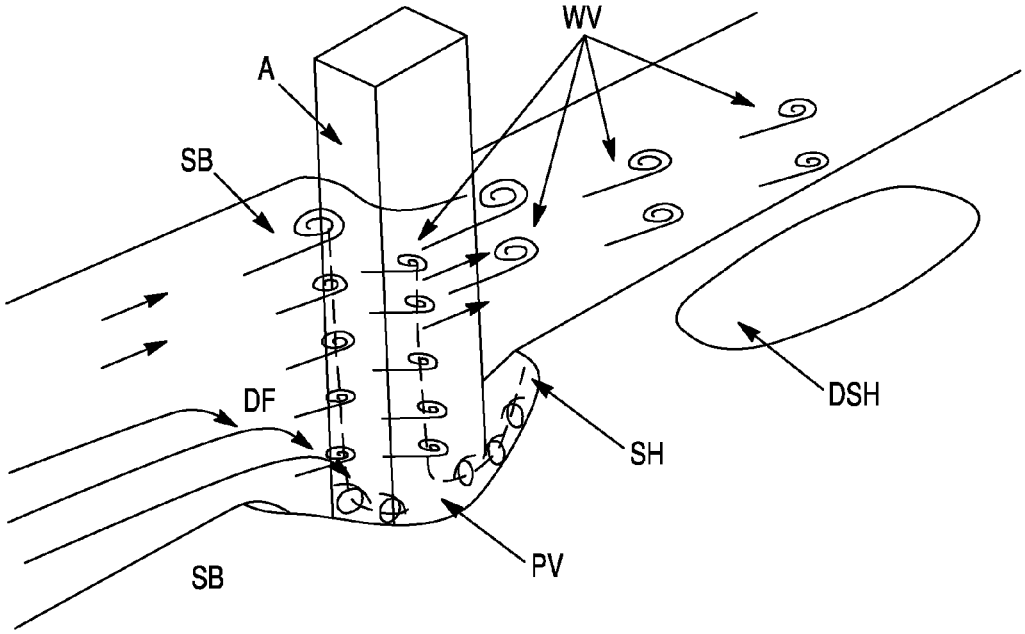
Fig. 2 Prior Art
Figure 3:
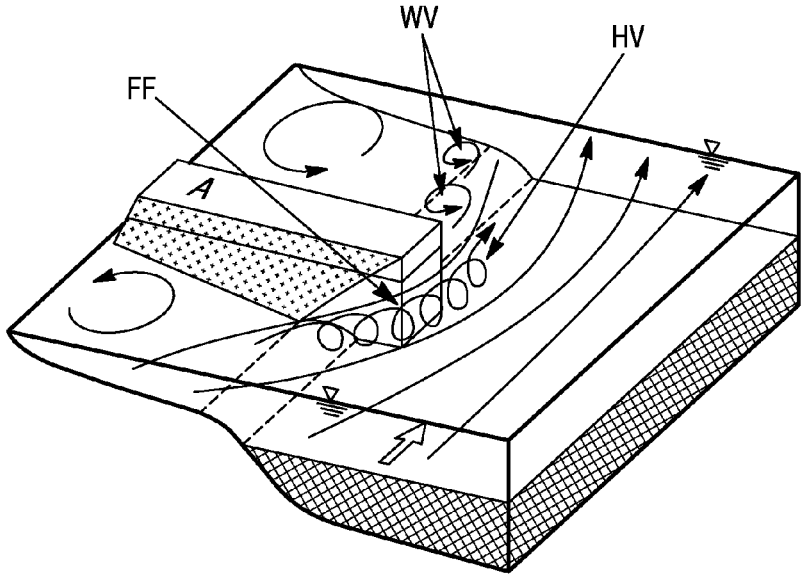
Fig. 3 Prior Art
Figure 4:
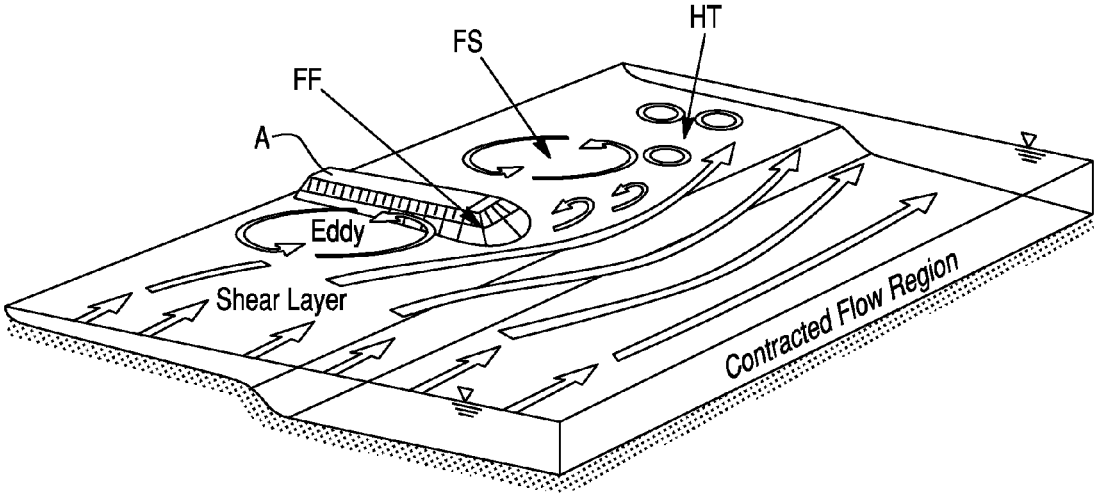
Fig. 4 Prior Art

In similar manner to piers, the vortical flow that approaches the bridge abutment (6) of FIG. 6 encounters the hyper-elliptical fairing nose (1) or pier abutment nose (5). These shapes reduce the adverse pressure gradients in the flow and keep the approaching boundary layer attached to the abutment surface. By keeping the boundary layer attached, the vortical 'roll-up' illustrated in FIG. 2 is avoided. The flow attached to the fairing nose (1) continues around the body and remains attached over the faired prismatic sections (2). At the downstream end of the abutment, the flow will naturally decelerate and produce large-scale unsteady structures with varying lift and shear. The vortex generators (3) placed on prismatic sections (2) mitigate the separation-induced large scale structures by energizing the decelerated near wall flow with higher-momentum outer layer flow. The energized flow encounters the faired downstream structure (4) and produces a more steady, compact separation and wake. The faired abutment nose (5) promote more steady, attached flow on the upper pier structure to avoid strong vortical shedding or vertical vortex attachment to the bed.

The present invention is unique in leveraging the aspects and understanding of three-dimensional turbulent boundary layer separation created by junction flow phenomena. No other design, patent or prior disclosed work has set forth a fully-three dimensional shape that has been proven to prevent the leading edge horseshoe vortex and mitigate the downstream separation-induced local scour around piers. We have unique expertise in this field, which has led to the development of the invention, as evidenced by the review papers written on the subjects of separated flow and junction flows by one current inventor (Simpson, 1989, 1996, 2001) in the field-renowned Annual Reviews of Fluid Mechanics and Progress in Aerospace Sciences.

Invention Operation and Test Results:

Bridge Piers

Two optimum streamlined bridge pier fairing shapes were tested in model scale water flume bed scour tests. The fairings with attached vortex generators meet the fairing and vortex generator design requirements mentioned above, namely (a) that for a minimal sized fairing the stream-wise gradient of the surface vorticity flux does not exceed the vorticity diffusion rate in the boundary layer, thus preventing the formation of a discrete vortex and (b) the attached vortex generators are sized and placed according to the above mentioned requirements. The following discussion shows that these cases prevent scouring vortex formation. These flume test results show that the bridge pier front fairing established flow conditions that prevented the formation of vortices, prevented local scour and resulted in the flow remaining attached to the pier even at very large angles of attack. The vortex generator greatly and efficiently controlled 3D separation on the downstream fairing and flow stayed attached over most of the surface area, greatly mitigating conditions resulting in the scouring problem around the bridge pier junction.

Straight-Ahead Bridge Pier Case

Figure 10A:
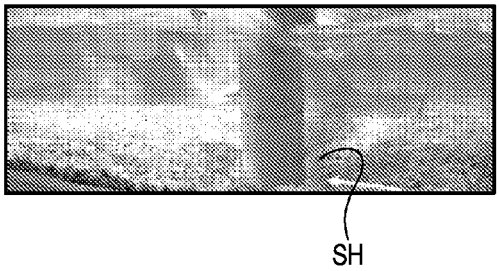
FIGS. 10*a* and 10*b* illustrate water flume test results for scour around a circular pier without a fairing (FIG. 10*a*), but no scour for the vortex preventing fairing on Model #1 with straight ahead flow (FIG. 10*b*).

For the straight-ahead case, the AUR (Against Underwater Rampage) bridge pier model #1 or #2 of FIGS. 5*a* and 5*b* was aligned with the plexiglass sidewall and leveled with a level gauge. The inflow speed was about 0.64 m/s and water depth was about 0.165 m resulting in incipient open bed scour conditions, which means that any increase of flow speed would result in scour of the pea gravel flume bed not close to the pier model. After starting the test, in front of the comparison case circular cylindrical pier a primary horseshoe vortex was formed which was the prime agent responsible for local scour. At the beginning of the test, the form of the horseshoe vortex triggered the scour process. Pea gravel were elevated and carried away downstream. After running for about one hour, a big scour hole was formed around the circular pier. A pile of gravel accumulated downstream of the circular pier, as shown in FIG. 10*a* and FIG. 11*b*.

Figure 10B:
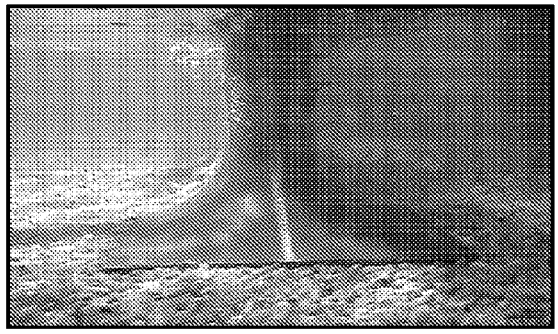
Figure 11A:
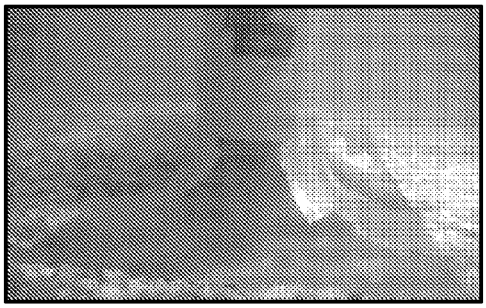
FIGS. 11*a* and 11*b* illustrate water flume test results for scour around a circular pier without a fairing (FIG. 11*b*), but no scour for the vortex preventing fairing on Model #2 with straight ahead flow (FIG. 11*a*).
Figure 11B:
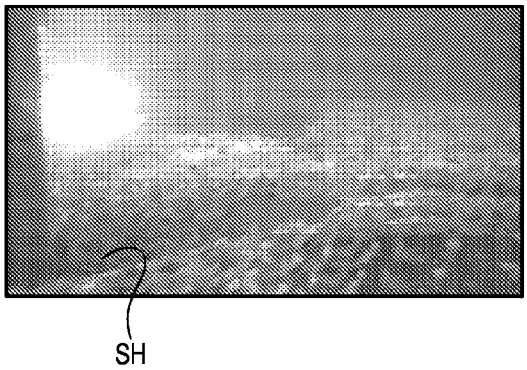

During the entire process, there was no scour evidence observed around the AUR bridge pier models as shown in FIG. 10*b* and FIG. 11*a*. Oil flow visualization and CFD (computational fluid dynamics) on the current AUR models show that flow spreads around the front fairing along the centerline and the saddle separation at the front fairing is located on the pier surface and much further away from the pier junction. The vortices created by the vortex generators energize the near-wall low speed flow and flow stays attached to the downstream fairing. Therefore, the current designs prevent local scour around the AUR models for the straight-ahead case.

Angle of Attack Effect on Local Scour around the scAUR™ Models

The angle of attack is the angle between the direction of the major axis of the bridge pier model and the direction of the flow. For a given bridge pier model, both the 3D pier shape as encountered by the flow and the pier projected width to the flow are primary factors which influence local scour around the bridge pier model. The angle of attack not only strongly affects the depth of the scour hole, but also affects the shape of the scour hole. To examine the scour with flow at an angle of attack to the scAUR™ models, the angle of attack was varied from 0 to 20°. The test conditions included a flow speed of nominally 0.64 m/s and a water depth of 0.165 m.

Figure 12A:
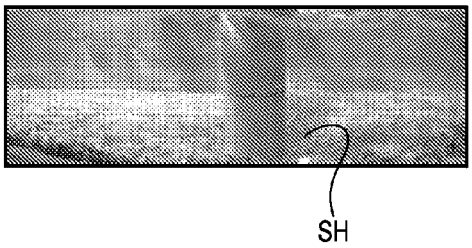
FIGS. 12*a* and 12*b* illustrate water flume test results for flow at a high angle of attack (ACM) of 20 degrees with a scour hole shown in FIG. 12*a* and FIG. 12*b* shows pier Model 1 with no scour.
Figure 12B:
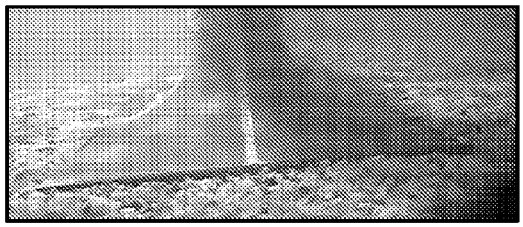
Figure 13A:
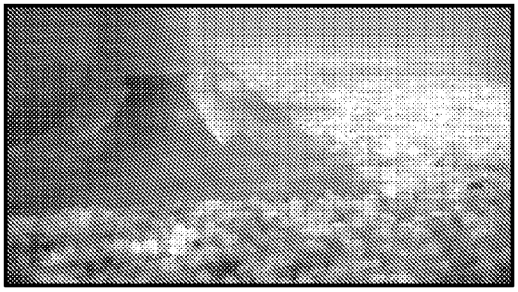
FIGS. 13*a* and 13*b* illustrate water flume test results for flow at a high angle of attack (MA) of 20 degrees to pier Model 2 with no scour.
Figure 13B:
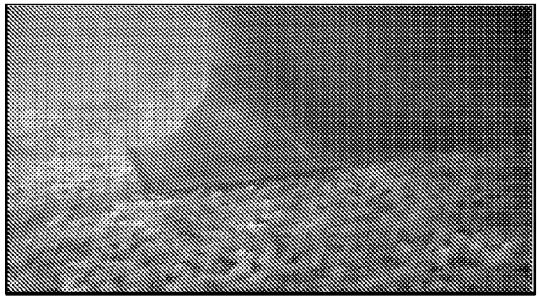
Figure 14:
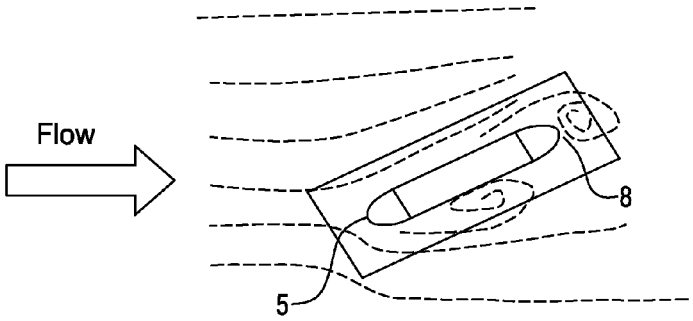
FIG. 14 shows a plan view sketch of the inclined vortex structure around the AUR model #1 at large angles of attack.

The scour test results for the 20° angle of attack case are given in FIG. 12 and FIG. 13. During these tests, the same size large scour hole appeared around the circular pier (FIG. 12*a*). Gravel around the scAUR models was stationary at all times and no local scour occurred. Unlike the straight-ahead case, highly inclined vortices appeared around the from nose and back pier stern as shown in FIG. 14. The flow visualization videos with a single tuft show that at twenty degrees angle of attack, the inclined vortices were attached to the model surface in the near wall region. Since the enhanced shearing and low pressure regions from the vortices were restricted to the fairing surface, no scour hole was observed on the gravel bed.

Therefore, the scAUR™ streamlined pier fairing acts to prevent river bed scour even at very large angles of attack up to twenty degrees. The fairing works by carefully altering the near-bed approach flow to prevent separation on the windward side of the pier and greatly reduce leeside separation through a combination of shape streamlining and placement of newly designed vortex generators. It has been shown that these vortex generators, designed for ease of manufacture and insusceptibility to trapped debris, greatly and efficiently controlled 3D separation on the downstream fairing, preventing concerns with scour downstream of the pier.

Bridge Abutments

The flow field around a vertical-wall abutment is highly three-dimensional and very complex, as shown in FIG. 2. The complex flow involves highly separated vortex flow around the abutment and the flow structures are summarized as a primary vortex, a separation bubble and wake shedding vortices. Several of the unsuccessful current countermeasures for abutment scour that are mentioned above were tested and are reviewed in the following discussion. The flume test results at incipient scour condition show that the flat collar surrounding the vertical-wall abutment failed as a scour countermeasure. Test results show that the scAUR™ fairing prevents the upstream scour hole and with proper installation of VorGAUR™ vortex generators on the scAUR™ fairing, downstream flow separation and local scour near the abutment are greatly suppressed.

Figure 15A:
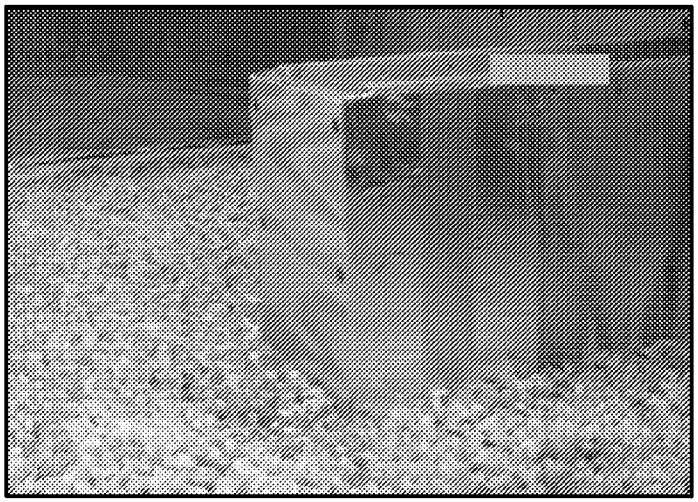
FIGS. 15*a*-15*c* illustrate bed elevation contours around vertical-wall abutment with no anti-scour treatment; L is the protrusion length and H is the water depth (Case #1).
Figure 15B:
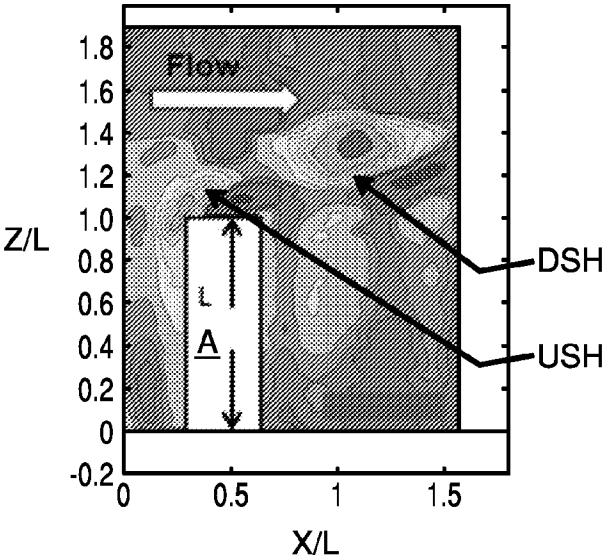
Figure 15C:
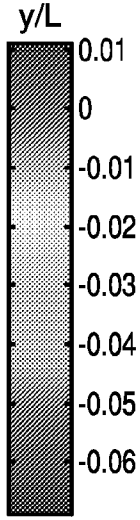

Study of the Effectiveness of a Flat Collar as an Abutment Scour Countermeasure—a Faulty Approach FIG. 15*a* shows the bed elevation result of the flume test of a vertical-wall abutment (A) with an aspect ratio (the ratio of protrusion length to water depth) equal to 2.875 and no anti-scour treatment or device. Case #1 in FIG. 15*a* shows that the primary vortex occupies the upstream scour hole (USH) and the wake vortices lift up gravel and produce the downstream scour hole (DSH).

Figure 16C:
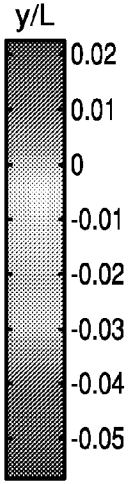
FIGS. 16-16*f* illustrate two cases of bed elevation contours around vertical-wall abutment with flat collar (Cases #2 shown in FIGS. 16*a*-16*c* and #3 shown in FIGS. 16*d*-16*f*).
Figure 16B:
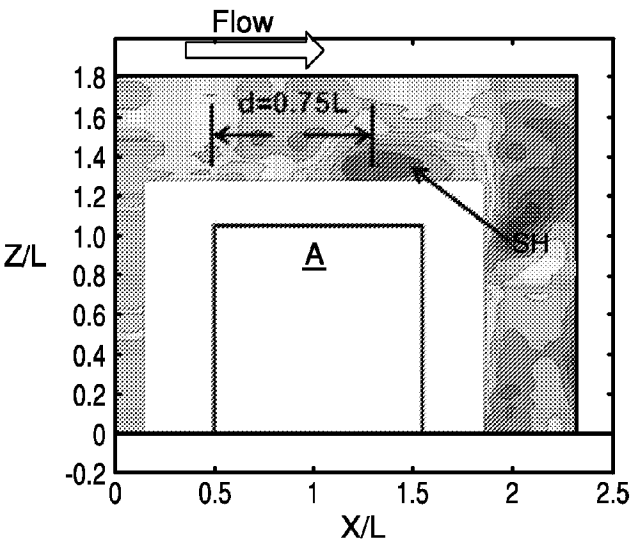
Figure 16A:
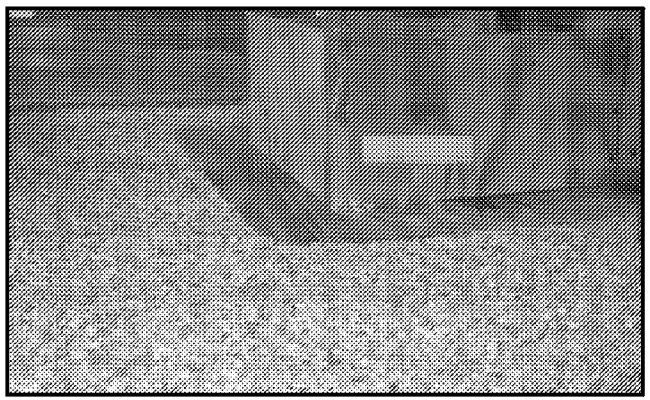
Figure 16F:
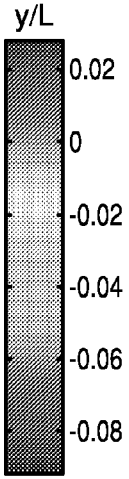
Figure 16E:
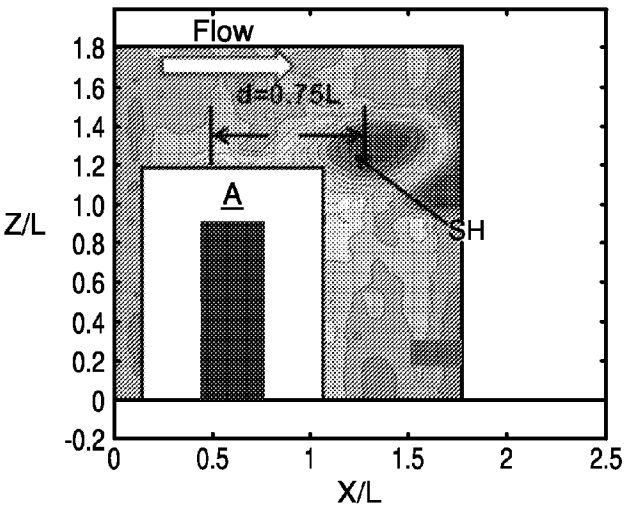
Figure 16D:
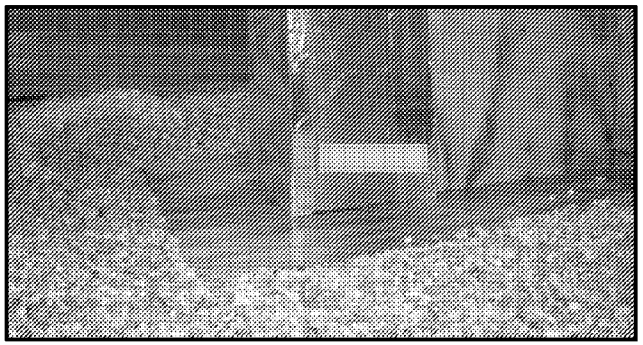

The vertical-wall abutments (A) in case #1 of FIG. 15*a* and case #3 of FIG. 16*d* are identical. The abutment in case #3 is surrounded by an extra flat apron, which is implemented to control the local scour around the abutment (A). However, the flume test results in FIG. 16*d* show that the flat collar surrounding the vertical-wall abutment fails as a scour countermeasure. The scour hole (SH) at the upstream corner is prevented. However, the downstream scour due to the wake vortex shedding becomes more severe and the maximum scour depth is about 0.09 L, which is about 30% deeper than the case without the flat collar. This is mainly because more vortex energy is dissipated at the upstream scour hole when there is no flat collar, resulting in less vortex energy downstream.

Cases #2 and #3 in FIGS. 16*a* and *b* have the same protrusion abutment length to the main flow, but with different widths. Even with different widths, both downstream scour holes occur at about 0.75 L to the upstream edge of the abutments. The bed elevation results in FIG. 16 demonstrate that the downstream scour hole is mainly affected by the wake vortices from the upstream corner. The wake vortices from the downstream corner in case #3 make the scour hole even larger.

Figure 18A:
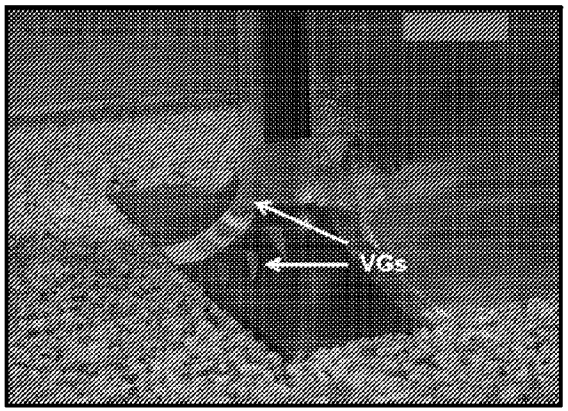
FIGS. 18*a*-18*c* illustrate bed elevation contours around vertical-wall abutment with streamlined fairing and vortex generators (Case #5).
Figure 18B:
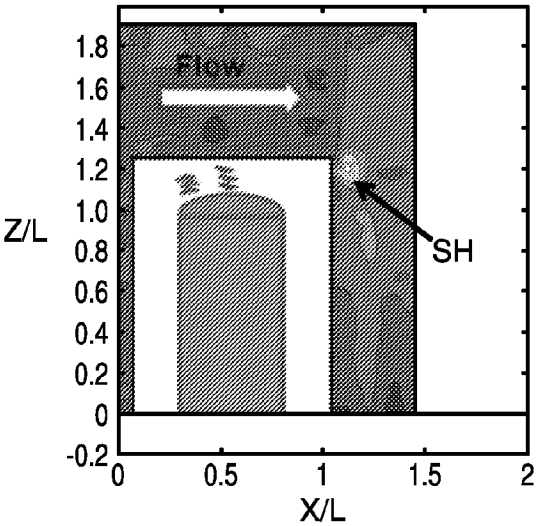
Figure 18C:
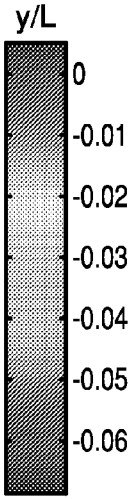
Figure 18D:
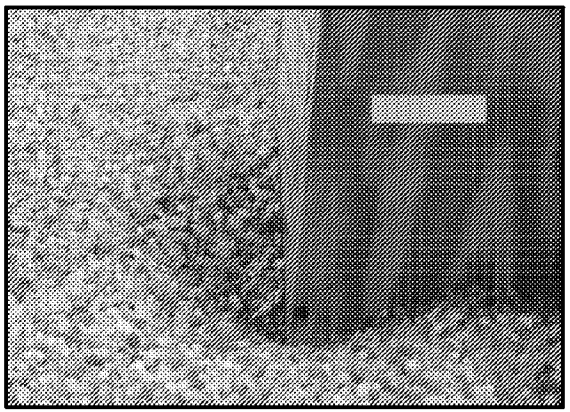
FIGS. 18*d*-18*f* illustrate bed elevation contours around (Case #6).
Figure 18E:
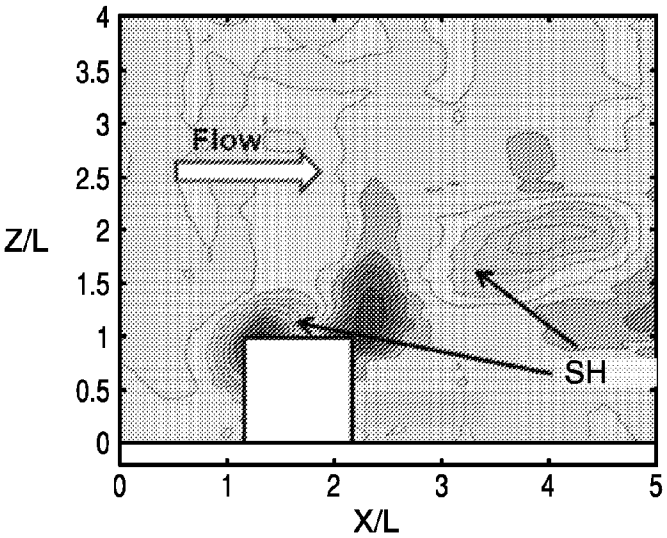
Figure 18F:
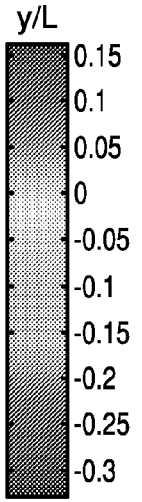

Study of the Effectiveness of the scAUR™ Fairing and VorGAUR™ Vortex Generators as Passive Flow Control to Prevent Abutment Scour FIG. 15*a* (Case #1) and FIG. 18*d* (Case #6) show that two large scour holes (SH) occur around the vertical-wall abutments without any scour countermeasure. The upstream scour hole (USH) is caused by the primary vortex and the downstream scour hole is mainly caused by the wake shedding vortices. The scAUR™ fairing is secured around the vertical-wall abutment to suppress and control the primary vortex and VorGAUR™ vortex generators are attached to the fairing surface to control downstream flow separation in the wake region in cases #5 (FIG. 18*a*) and #7 (FIG. 19*a*).

Figure 17A:
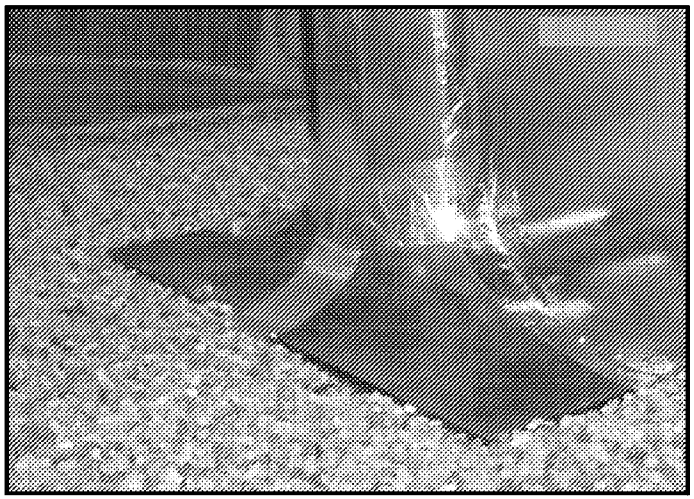
FIGS. 17*a*-17*c* illustrate bed elevation contours around vertical-wall abutment with streamlined fairing without vortex generators (Case #4).
Figure 17B:
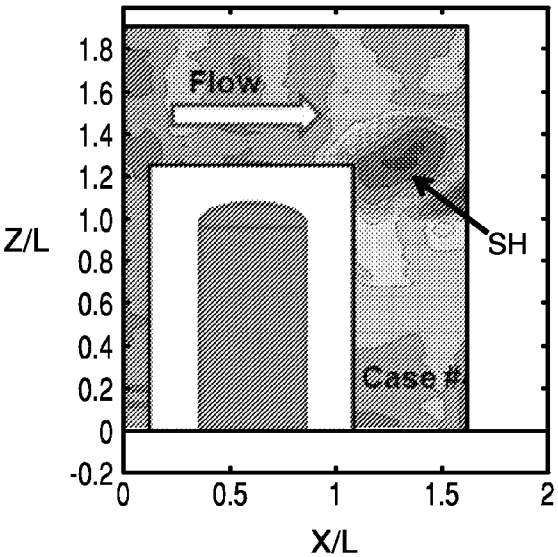
Figure 17C:
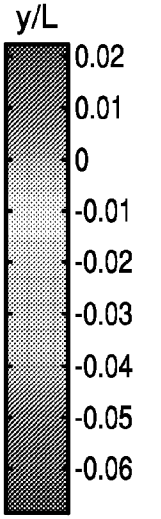

FIG. 17*a* demonstrates for Case #4 that with the scAUR™ fairing around the abutment, the upstream scour hole vanishes, but the downstream scour hole still exists because no vortex generator control is used. The flow visualization video shows massive flow separation on the downstream fairing.

Figure 19A:
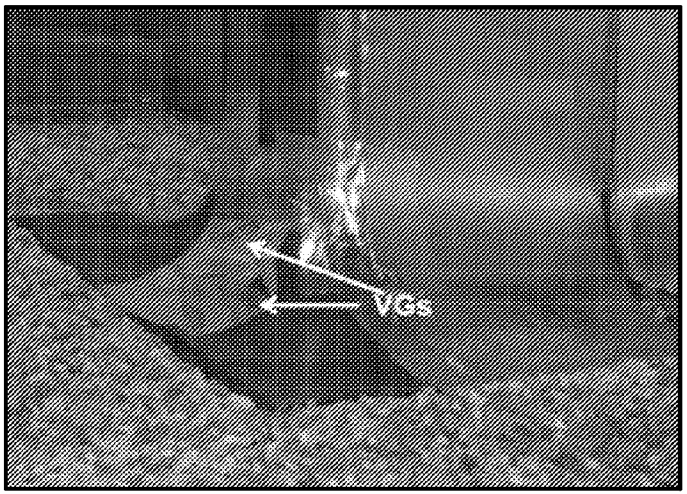
FIGS. 19*a*-19*c* illustrate bed elevation contours around vertical-wall abutment with streamlined fairing and vortex generators (Case#7).
Figure 19B:
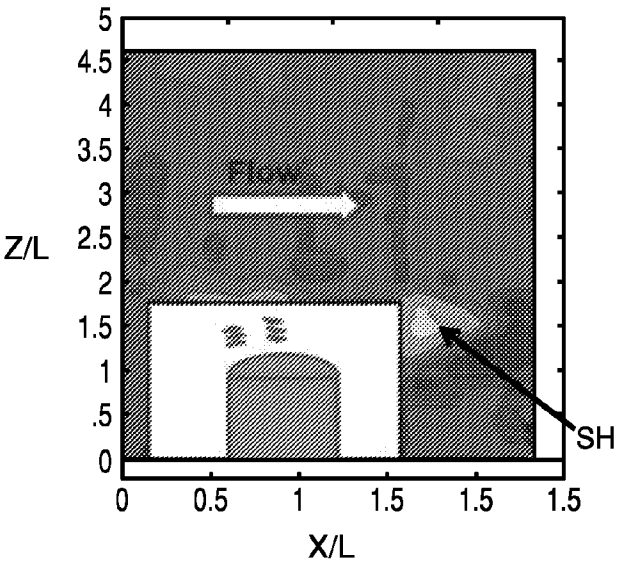
Figure 19C:
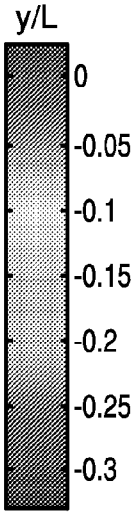
Figure 20:
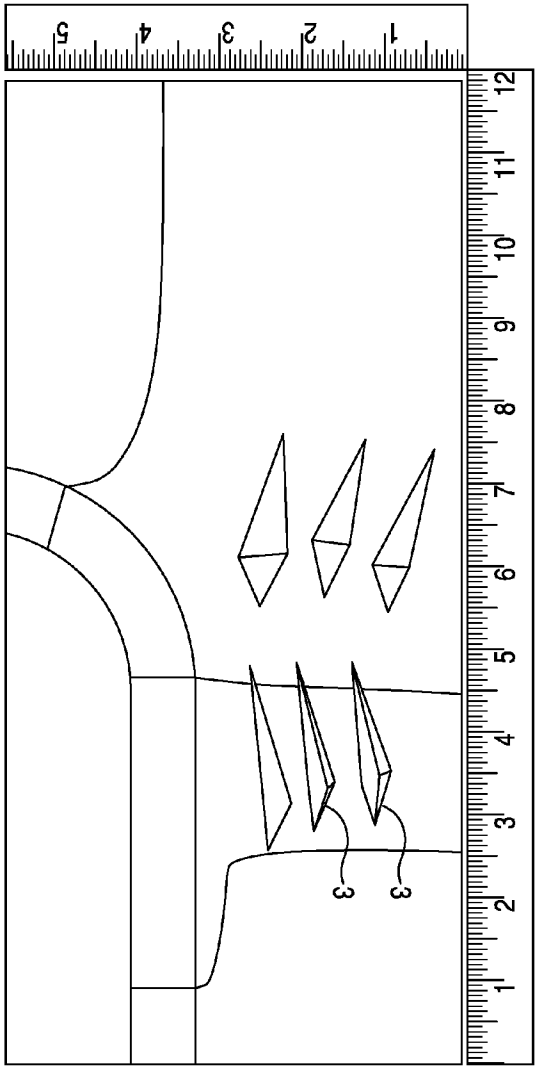
FIG. 20 is a plan view of vortex generators around an abutment.

VorGAUR™ vortex generators are attached to the scAUR™ fairing to control downstream flow separation as shown in FIGS. 18*a* and 19*a* for cases #5 and #7 and in FIG. 20. These tetrahedral vortex generators have a similar shape. FIG. 20 is the top view of the VorGAUR™ vortex generators on the scAUR™ fairing and it presents an arrangement of vortex generators around the scAUR™ abutment fairing.

In case #5 (FIGS. 18*a*-18*c*), two rows of vortex generators are installed and the second row is staggered about a half vortex generator length downstream of the first row, as shown in FIG. 18*a*, to counteract naturally occurring counter-clockwise rotating wake vortices. The second row of vortex generators produces clockwise vortices (looking downstream). With the implementation of the second row of vortex generators, the downstream scour hole is greatly suppressed by at least 80%.

Another vertical-wall abutment with a different aspect ratio is evaluated in flume tests, as shown in FIG. 19*a*. It again demonstrates that with the scAUR™ fairing and proper installation of vortex generators, the upstream scour hole is eliminated and the downstream scour hole is greatly suppressed.

Example Manufacturing and Installation Process for the Three-dimensional Fairing and Vortex Generators This three-dimensional streamline fairing can be made of composite materials, made on-site in situ wet cast concrete segments inside female fiberglass or composite material molds, or made in precast concrete segments and cast inside female fiberglass or composite material molds and delivered and installed on site. The manufacturing process for the female fiberglass or composite material molds applies existing molding technology which is a standard process for fiberglass boat manufacturing.

Before pouring or installing the concrete fairing, the riverbed around the pier must be flattened. If needed, concrete piles are constructed later, before pouring the concrete footing for the fairing. A cofferdam may be applied and allows installing the concrete fairing segments under dry conditions. The construction process for the cofferdam is described in the AASHTO LRFD Bridge Construction Specifications (AASHTO, 2010). The concrete class for all substructure elements shall normally be Class 4000 (AASHTO, 2010). The self consolidating concrete is preferred to ensure the best surface finish on the fairing and remove the air bubbles.

Figure 21:
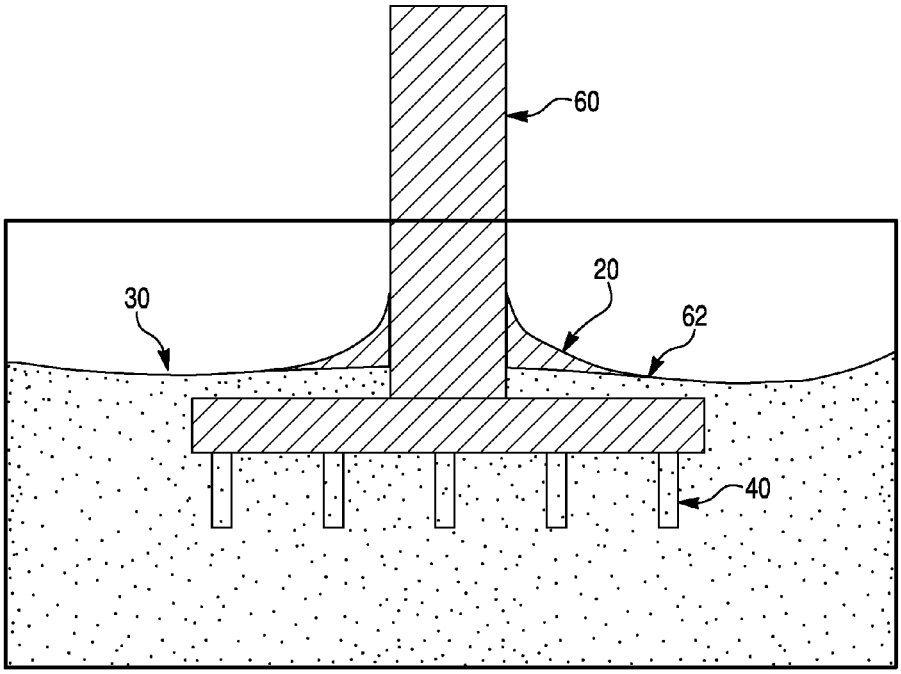
FIG. 21 shows a cross-sectional view of the scAUR™ three-dimensional streamline fairing in accord with the present invention.

In FIG. 21, a cross-sectional view of the scAUR™ three-dimensional streamline fairing shown in FIG. 5*a* depicts it extending outwardly from the hydraulic substructure to prevent scouring action of sediment material 30 around the footing. As shown in FIG. 21, the bridge pier 60 footing 62 is part of the pier substructure 40, which is usually placed below the ground surface and transmits the load to the underlying soil. Therefore, the scAUR™ 3D fairing 70 for bridge pier vortex prevention as a scour countermeasure need not be attached to the bridge pier 60 to avoid the load from bridge pier 60. Separate attachment to an independently supported foot 62 would allow more protection for the pier 60 in the case of an impact load from the river.

Figure 22:
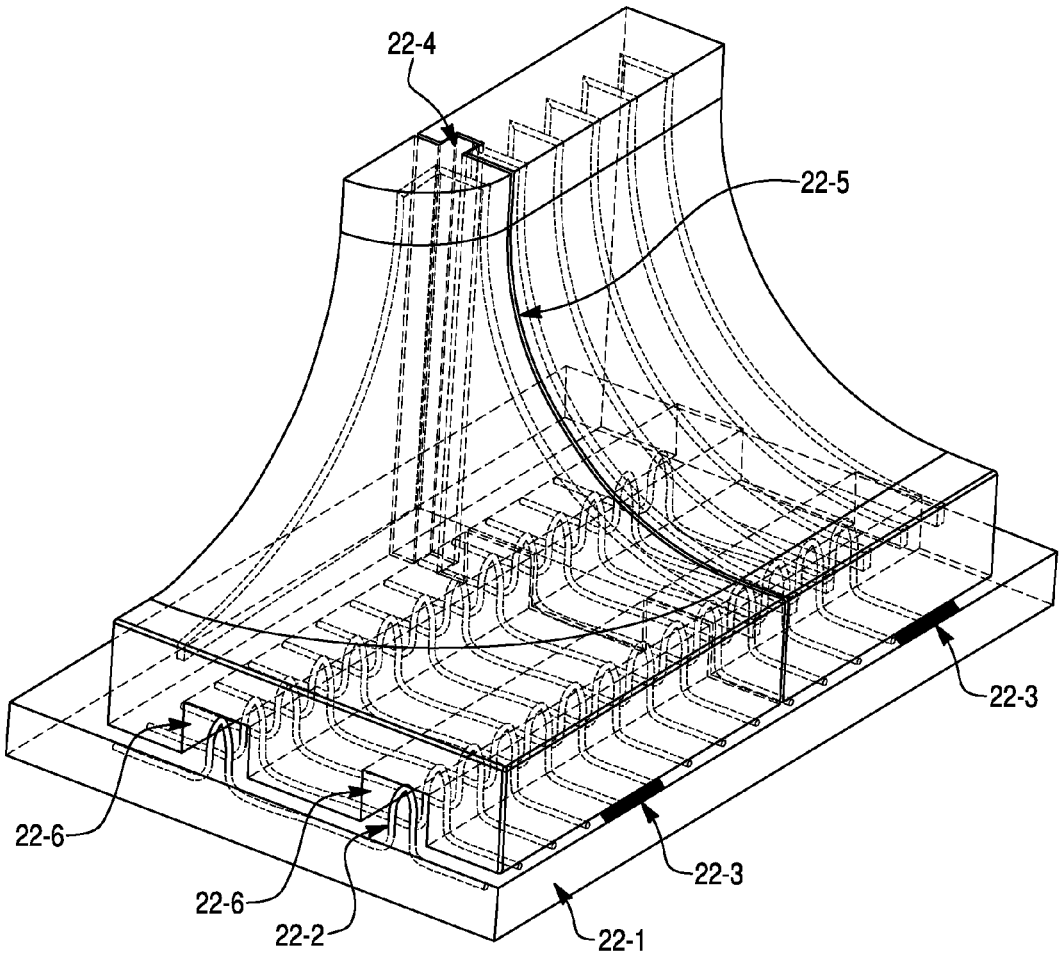
FIG. 22 shows the joint design for installation of precast fairing segments of a fairing in accord with the present invention.
Figures 23, 23A:
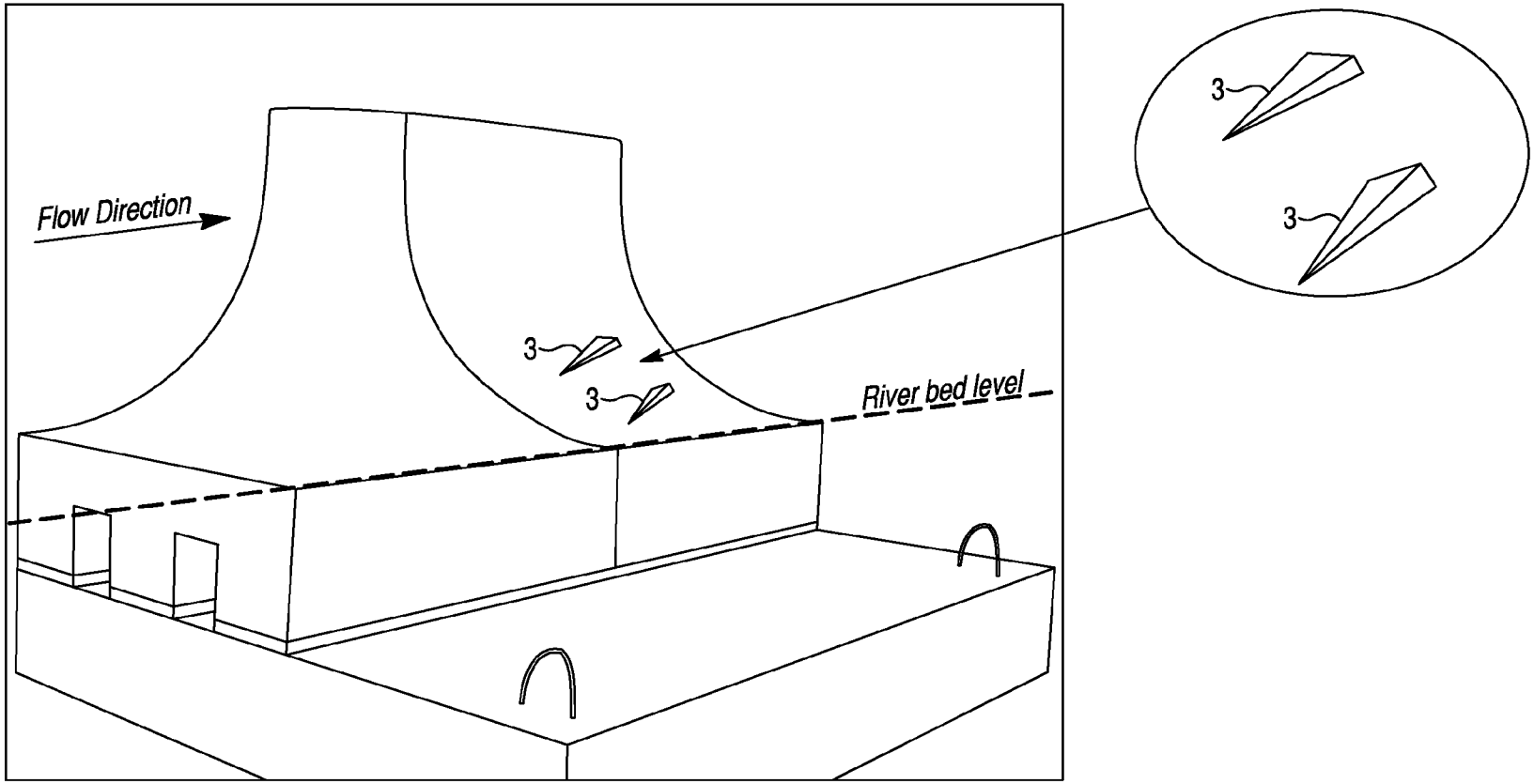
FIG. 23 is a photograph of precast manufactured segments of the streamlined fairing.
FIG. 23*a* is an enlarged view of the vortex generators shown in FIG. 23.

The installation of precast reinforced concrete fairing segments at the pier or abutment jobsite uses an interlocking scheme shown in FIGS. 22 and 23. In this design, a separate footing (22-1) is constructed around the pier and near the ground. The exposed loop connectors (22-2) are welded to the reinforcement bar embedded in the footing. Special 1" thick stainless steel shims (22-3) are placed at the bedding layer between the footing and fairing segment to aid in pressure grouting. Interlocking keys (22-4) on the fairing segments and footing help the alignment and installation process. After the fairing segments are aligned, the circumference is sealed with flat collar forms and non-shrink, non-metallic grout is injected into the cavities between the fairing segments (22-5) and footing (22-6) and voids around the interlocking keys (22-4). Air venting features of the key design are specially designed to assist injection of the grout.

Figure 24A:
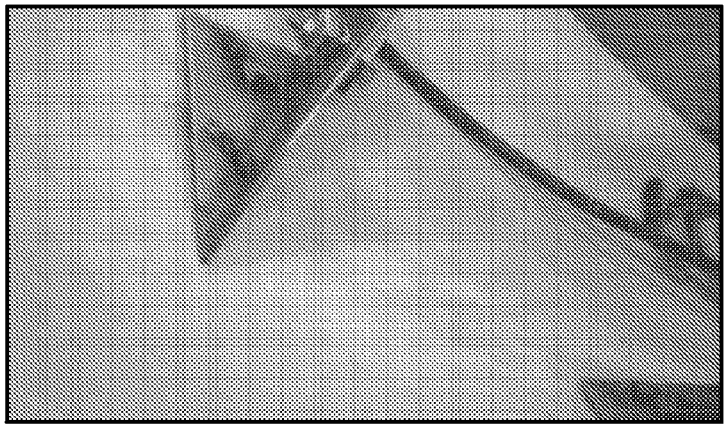
FIGS. 24*a*-24*c* illustrate the vortex generator manufacturing processes.
Figure 24B:
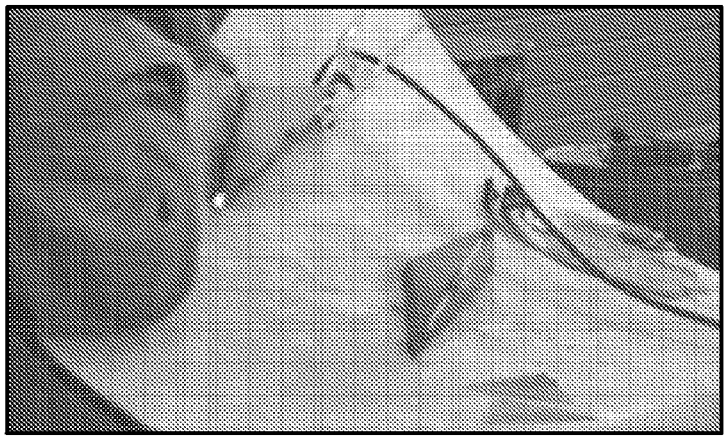
Figure 24C:
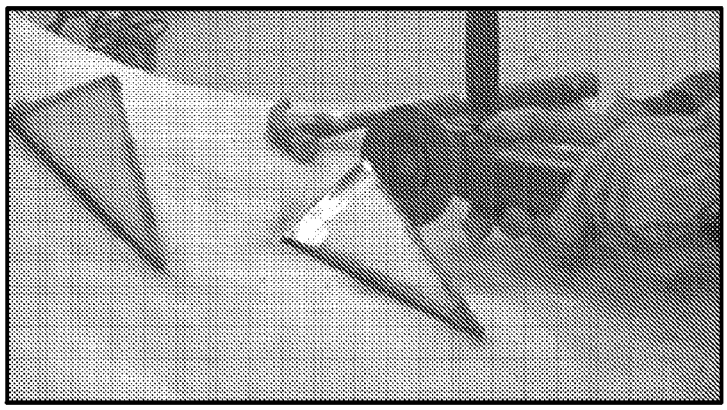

The vortex generator parts 3 of FIGS. 23 and 23*a* are in triangular shape and made of super-corrosion-resistant stainless steel. The finished plates are in excellent quality and high durability. As shown in FIGS. 24*a-c*, the base plate and the vertical plate (parts #3-1 and 3-4 in FIG. 7, are first welded together, and then connected to the concrete reinforced concrete structure of the appropriate fairing segment through recess holes on the base plate. Once it's in position, two other triangular plates (parts #3-2 and 3-4) are welded to the above structure. A handheld grinder is used to grind down the weld beads on the edges to ensure sharp edges on the final products.

Thus, the present invention in practice is a concrete or fiber-reinforced composite, or combination of both, vortex generator equipped hydrodynamic fairing that is fit or cast over an existing or new hydraulic structure around the base of the structure and above the footing. The product is manufactured using existing technologies well known to professionals proficient in the practice of fiber-reinforced composite mold manufacturing, concrete technologies, and bridge construction.

While the present invention has been described herein with respect to particular examples, variations will occur to those of ordinary skill in the relevant field. This invention is only limited solely by the following claims.

The invention claimed is:

1. A three-dimensional convex-concave hydraulic structure fairing, equipped with at least one vortex generator, for reducing drag and flow blockage, preventing flow-borne debris build-up, flow overtopping frequency, riverbed junction scour, and protecting said hydraulic structure from flow-borne impact loads, with a shape that further prevents the formation of scouring vortices for a range of river inflow angles of attack and upstream swirl of flow passing a hydraulic structure, comprising:

a streamlined fairing installed around a perimeter of said hydraulic structure and extending from a height above a river on said structure to a bed of said river surrounding said structure, said streamlined fairing completely enveloping said hydraulic structure and providing a faired shape in a direction of flow of said river, said fairing including a streamlined nose and a streamlined stern, each said nose and stern having a convex shape along each horizontal plane and a concave shape along each vertical plane perpendicular to surfaces of the fairing, said convex and said concave shapes intersecting at each point on the surfaces of said streamlined nose and stern;

at least one vortex generator attached to a surface of said streamlined fairing beyond a streamlined nose thereof and along a longitudinal distance of a stem to stern dimension of said streamlined fairing, and being proximal to said river bed in a flow region void of adverse pressure gradients that persist downstream of said at least one vortex generator for at least one length of said at least one vortex generator, so as to energize a portion of near wall flow with higher-momentum outer layer flow to produce a steady, compact separation and wake and prevent formation of scouring vortices within said river flow.

2. The fairing as in claim 1, wherein;

said hydraulic structure is a bridge abutment.

3. The fairing as in claim 1, wherein:

said hydraulic structure is a pier and said at least one vortex generator comprises two vortex generators positioned on opposed surfaces of said streamlined fairing.

4. The fairing as in claim 1, wherein:

the fairing is constructed of reinforced concrete.

5. The fairing as in claim 4, wherein:

the fairing is composed of members cast in place around the structure using molds.

6. The fairing as in claim 5, wherein:

said molds become part of the hydraulic structure fairing.

7. The fairing as in claim 4, wherein:

the hydraulic structure fairing is comprised of elements that are precast and interlock using matching keys among individual precast concrete elements.

8. The fairing as in claim 1, wherein:

the streamlined fairing and said at least one vortex generator is constructed of fiber reinforced polymers.

9. A three-dimensional convex-concave hydraulic structure fairing, equipped with at least one vortex generator, for reducing drag and flow blockage and preventing flow-borne debris build-up, flow overtopping frequency, riverbed junction scour, and protecting said hydraulic structure from flow-borne impact loads, and having a shape that further prevents the formation of scouring vortices for a range of river inflow angles of attack and upstream swirl of flow passing an hydraulic structure, comprising:

a streamlined fairing installed around a perimeter of said hydraulic structure and extending from a height above a river on said structure to a bed of said river surrounding said structure, said streamlined fairing completely enveloping said hydraulic structure and providing a faired shape in a direction of flow of said river;

at least one vortex generator attached to a surface of said streamlined fairing beyond a streamlined nose thereof and along a longitudinal distance of a stem to stern dimension of said streamlined fairing, and being proximal to said river bed in a flow region void of adverse pressure gradients that persist downstream of said at least one vortex generator for at least one length of said at least one vortex generator, so as to energize a portion of near wall flow with higher-momentum outer layer flow to produce a steady, compact separation and wake and prevent formation of scouring vortices within said river flow, wherein said at least one vortex generator is tetrahedral in shape and include four triangular faces, three of which meet at each vertex.

10. A method of using a three-dimensional convex-concave hydraulic structure fairing whose shape prevents the formation of scouring vortices for a range of river inflow angles of attack of flow passing said hydraulic structure, the method comprising the steps of:

selecting, in accord with computational fluid dynamics and water flume river bed scour studies, a suitable streamlined fairing, and installing said fairing around a perimeter of said hydraulic structure and extending from a height above a river on said structure to a bed of said river surrounding said structure, said suitable fairing completely enveloping said perimeter of said structure and providing a faired shape to said hydraulic structure in a direction of flow of said river, said faired shape having a streamlined nose and a streamlined stern, each having a convex shape along each horizontal plane and a concave shape along each vertical plane perpendicular to surfaces of the fairing, said convex and said concave shapes intersecting at each point on the surfaces of said streamlined nose and stern;

attaching vortex generators to surfaces of said fairing downstream from a forward, upstream portion of the streamlined fairing and along a longitudinal distance of a stem to stern dimension of said fairing, and being proximal to said river bed in a flow region void of adverse pressure gradients that persist downstream of said vortex generators for at least one length of said generators, so as to energize a near wall portion of the flow of river current with higher momentum outer layer flow to induce steady, compact separation and wake and thereby oppose formation of scouring vortices within said river flow around said fairing.

11. The method as in claim 10, wherein;

said hydraulic structure is a bridge abutment.

12. The method as in claim 10, wherein:

said hydraulic structure is a pier.

13. The method as in claim 10, wherein:

said vortex generators are tetrahedral in shape and include four triangular faces, three of which meet at each vertex.

14. The method as in claim 10, wherein:

the fairing is constructed of reinforced concrete.

15. The method as in claim 14, wherein:

the fairing is composed of separate members which are cast in place around the structure using molds.

16. The method as in claim 15, wherein:

said molds become part of the fairing.

17. The method as in claim 14, wherein:

the fairing is comprised of elements that are precast and interlock using matching keys among individual precast concrete elements.

18. The method as in claim 10, wherein:

the fairing and vortex generators are constructed of fiber reinforced polymers.

19. A three-dimensional convex-concave hydraulic structure fairing, equipped with at least one vortex generator, for reducing drag and flow blockage, preventing flow-borne debris build-up, flow overtopping frequency, riverbed junction scour, and protecting said hydraulic structure from flow-borne impact loads, with a shape that further prevents the formation of scouring vortices for a range of river inflow angles of attack and upstream swirl of flow passing a hydraulic structure, comprising:

a streamlined fairing installed around a perimeter of said hydraulic structure and extending from a height above a river on said structure to a bed of said river surrounding said structure, said streamlined fairing completely enveloping said hydraulic structure and providing a faired shape in a direction of flow of said river, said fairing including a streamlined nose having convex shape along a horizontal direction and a concave shape along a vertical direction, said convex and said concave shapes intersecting on said streamlined nose;

at least one vortex generator attached to a surface of said streamlined fairing beyond a streamlined nose thereof and along a longitudinal distance of a stem to stern dimension of said streamlined fairing, and being proximal to said river bed in a flow region void of adverse pressure gradients that persist downstream of said at least one vortex generator for at least one length of said at least one vortex generator, so as to energize a portion of near wall flow with higher-momentum outer layer flow to produce a steady, compact separation and wake and prevent formation of scouring vortices within said river flow.

* * * * *